US010189591B2

(12) United States Patent
van der Meijden et al.

(10) Patent No.: US 10,189,591 B2
(45) Date of Patent: Jan. 29, 2019

(54) ROTARY FILLING DEVICE FOR ASEPTIC FILLING OF POUCHES

(71) Applicant: Scholle Corporation, Northlake, IL (US)

(72) Inventors: Wim van der Meijden, Scherpenzeel (NL); J. A. M. Holsink, Hilversum (NL); W. H. Th. Miltenburg, Amersfoort (NL); Sean Fitzgerald, West Dundee, IL (US)

(73) Assignee: Scholle IPN Corporation, Northlake, IL (US)

( * ) Notice: Subject to any disclaimer, the term of this patent is extended or adjusted under 35 U.S.C. 154(b) by 467 days.

(21) Appl. No.: 14/860,686

(22) Filed: Sep. 21, 2015

(65) Prior Publication Data

US 2017/0081060 A1 Mar. 23, 2017

(51) Int. Cl.

| | |
|---|---|
| ***B65B 43/50*** | (2006.01) |
| ***B65B 7/02*** | (2006.01) |
| ***B65B 3/04*** | (2006.01) |
| ***B65B 55/02*** | (2006.01) |
| ***B65B 7/28*** | (2006.01) |

(52) U.S. Cl.

CPC ..... *B65B 43/50* (2013.01); *B65B 3/045* (2013.01); *B65B 7/02* (2013.01); *B65B 7/2821* (2013.01); *B65B 55/027* (2013.01)

(58) Field of Classification Search

CPC ..... B65B 55/027; B65B 7/2821; B65B 7/02; B65B 3/045; B65B 43/50

USPC ..... 53/282, 276, 281, 284.7

See application file for complete search history.

(56) References Cited

U.S. PATENT DOCUMENTS

| | | | | |
|---|---|---|---|---|
| 3,499,568 | A | 3/1970 | Vinas Riera | |
| 4,394,923 | A | 7/1983 | Sugiyama | |
| 4,458,734 | A | 7/1984 | Scholle et al. | |
| 6,889,482 | B2 * | 5/2005 | Edwards | B65B 3/04 53/109 |
| 2013/0160400 | A1 * | 6/2013 | Decio | B65B 1/04 53/284.7 |
| 2014/0345233 | A1 | 11/2014 | Parisini et al. | |

FOREIGN PATENT DOCUMENTS

| | | | |
|---|---|---|---|
| EP | 694477 | A1 | 1/1996 |
| EP | 1291162 | A1 | 3/2003 |
| JP | 2002-321715 | A | 11/2002 |
| JP | 2003-072717 | A | 3/2003 |
| JP | 2003-237742 | A | 8/2003 |

(Continued)

*Primary Examiner* — Thanh Truong
*Assistant Examiner* — Xavier A Madison
(74) *Attorney, Agent, or Firm* — The Watson IP Group, PLC; Jovan N. Jovanovic; Vladan M. Vasiljevic

(57) ABSTRACT

A filling device for aseptic filling of pouches comprising a pouch fill assembly having a movement assembly, a plug removing assembly and a filling assembly. The movement assembly defining an aseptic zone and configured to direct a pouch having a spout and a plug sealing the spout through the pouch fill assembly from an inlet to an outlet. The plug removing assembly having at least one plug removing station including a grasping assembly, a plug retaining structure and an actuator assembly. The filling assembly having at least one filling station structurally configured to dispense a flowable material into the pouch through the spout.

14 Claims, 11 Drawing Sheets

(56) References Cited

FOREIGN PATENT DOCUMENTS

| | | | |
|---|---|---|---|
| JP | 2006-206159 | A | 8/2006 |
| JP | 2016-8055 | A | 1/2016 |
| WO | 2012055459 | A1 | 5/2012 |
| WO | 2016189754 | A1 | 12/2016 |

* cited by examiner

ROTARY FILLING DEVICE FOR ASEPTIC FILLING OF POUCHES

CROSS-REFERENCE TO RELATED APPLICATION

N/A

BACKGROUND OF THE DISCLOSURE

1. Field of the Disclosure

The disclosure relates in general to aseptic filling, and more particularly, to a rotary filling device for filling of pouches.

2. Background Art

The filling of flexible packaging and pouches is known in the art. Generally, such filling occurs in an environment wherein the package is handled, opened, filled and then recapped. As requirements have become more stringent, the prospect of aseptic filling of flowable material, namely foodstuffs, has become significantly more important.

Aseptic filling is the filling of a product, for example, a foodstuff, in a sterile container. With the product being sterile as well, the foodstuff can keep for extended periods of time without the use of preservatives and/or refrigeration. Typically, such products are contained in flexible bags (as part of bag in box packaging) or in rigid packaging containers such as blown polymer bottles, or cartons made from paperboard laminations.

Problematically, it has been difficult to utilize standup pouches with fitments in the aseptic filling process. In particular, pouches tend to be difficult to sterilize and it has been costly to apply threaded closures to such packaging. Indeed, a cost effective solution for aseptic filling of standup pouches having fitments has been a challenge.

SUMMARY OF THE DISCLOSURE

The disclosure is directed to a filling device for aseptic filling of pouches comprising a pouch fill assembly having a movement assembly, a plug removing assembly and a filling assembly. The movement assembly defining an aseptic zone. The movement assembly configured to direct a pouch having a spout and a plug sealing the spout through the pouch fill assembly from an inlet to an outlet. The plug removing assembly has at least one plug removing station. The plug removing station further includes a grasping assembly, a plug retaining structure, and an actuator. The grasping assembly is positioned within the aseptic zone structurally configured to releasably capture a portion of the plug. The plug retaining structure is positioned within the aseptic zone structurally configured to releasably maintain the plug upon removal from the spout. The actuator assembly is structurally configured to direct the plug between the spout and the plug retaining structure. The filling assembly has at least one filling station structurally configured to dispense a flowable material into the pouch through the spout.

In some configurations, the movement assembly further includes a base wall, a portion of which is rotatably positionable relative to the plug removing assembly and the pouch filling assembly. A cooperative retaining slot is defined therein and is structurally configured to retain a pouch by way of the spout. The base wall includes an upper surface. The plug retaining structure is positioned in a spaced apart orientation from the cooperative retaining slot and extends from the upper surface. The grasping assembly is structurally configured to extend between the cooperative retaining slot and the plug retaining structure.

In some configurations, the actuator comprises an arm that is translatable and rotatable relative to the base wall, and that has the grasping assembly positioned proximate the lower end thereof. The grasping assembly has a first side and a second side with a capture slot defined in the first side. The capture slot has a retention portion configured to releasably engage the spout.

In some configurations, the retaining structure comprises an elongated post member extending outwardly from the upper surface of the base wall.

In some configurations, the movement assembly further comprises hoop like member defined by an inner wall, an outer wall, an upper wall and a base wall. The hoop like member having an axis of rotation. The base wall further includes an inner portion and an outer portion. One of the inner portion and the outer portion is fixedly coupled to the upper wall. The other of the inner portion and the outer porting is rotatably positionable relative to the upper wall.

In some configurations, the inner portion is rotatably positionable relative to the upper wall. The cooperative retaining slot portion of the inner portion directs movement of the spout, and in turn, the pouch. The plug removing station and the filler station are coupled to the upper wall so that the inner portion of the base wall is rotatably movable relative to the plug removing station and the filler station. The plug retaining structure is positioned proximate the cooperative retaining slot so as to extend from an upper surface of the inner portion of the base wall.

In some configurations, the inner wall is fixedly coupled to the inner portion of the base wall so as to rotate together therewith. The outer wall is fixedly coupled to the upper wall and to the outer portion of the base wall wherein the inner wall rotates relative to each thereof.

In some configurations, the movement assembly further includes a chamber seal between the inner wall and the upper wall. The chamber seal comprises a pair of opposing ridges extending from the inner wall to the upper wall, and sealingly engaging the upper wall, with a valley therebetween. The valley structurally configured to retain either a fluid or a gas therebetween.

In some configurations, the pouch filler assembly further includes a plug replacement assembly having at least one plug replacement station. The plug replacement station further comprising a grasping assembly, a plug retaining structure and an actuator. The grasping assembly is positioned within the aseptic zone structurally configured to releasably capture a portion of the plug. The plug retaining structure is positioned within the aseptic zone structurally configured to releasably maintain the plug upon removal from the spout. The actuator assembly is structurally configured to direct the plug between the spout and the plug retaining structure.

In some configurations, the movement assembly further comprises a rotary configuration having an axis of rotation, with the spout being rotatably movable along the rotary configuration. The plug removing assembly, the filling assembly and the plug replacement assembly being positioned sequentially in a rotary configuration. Upon rotation thereof, the spout and the plug progress sequentially from the plug removing assembly to the filling assembly and to the plug replacement assembly.

In another aspect of the disclosure, the disclosure is directed to a filling device for aseptic filling of pouches comprising a pouch fill assembly comprising a movement assembly, a plug removing assembly, a filler assembly, and a plug replacement assembly. The movement assembly defining an aseptic zone. The movement assembly defining a hooplike configuration, with a portion thereof being rotatable about an axis of rotation, and relative to another portion thereof which is substantially fixed. The rotatable portion including at least one cooperative retaining slot configured to releasably receive a spout of a pouch. The plug removing assembly has at least one plug removing station coupled to the fixed portion of the movement assembly. At least one plug retaining structure is coupled to the rotatable portion of the movement assembly proximate each cooperative retaining slot and rotatable therewith. The filler assembly has at least one filler head coupled to the fixed portion of the movement assembly downstream of the plug removing assembly. The plug replacement assembly has at least one plug replacement station. The plug replacement station is coupled to the fixed portion of the movement assembly downstream of the filler assembly. The rotatable portion is structurally configured to rotate at least one pouch and at least one plug associated with the pouch sequentially to each of the plug removing assembly, the filler assembly and the plug replacement assembly. A plug coupled to a pouch is removed, with the pouch filled and then the plug is replaced on the same pouch from which the plug was removed, with the plug rotating along with the pouch coupled to the rotatable portion.

In some configurations, the movement assembly further includes an inner wall, an outer wall spaced apart from the inner wall, an upper wall and a base wall spaced apart from the upper wall. The walls cooperate to define a substantially hoop like configuration. The base wall has an inner portion and an outer portion. One of the inner portion and the outer portion are rotatably positionable relative to at least one of the outer wall, the inner wall and the upper wall.

In some configurations, the inner portion of the base wall is rotatable relative to the outer portion of the base wall and the upper wall.

In some configurations, the movement assembly has a substantially rectangular cross-sectional configuration.

In some configurations, the plug removing assembly includes four stations, the plug replacement assembly includes four stations and the filler assembly includes four filler stations. The base wall includes sixteen cooperative retaining slots positioned therealong in a spaced apart configuration, and sixteen plug retaining structures positioned proximate the sixteen cooperative retaining structure.

In some configurations, the plug retaining structure including an elongated post member extending from the base wall and including a lower end and an upper end.

BRIEF DESCRIPTION OF THE DRAWINGS

The disclosure will now be described with reference to the drawings wherein.

DETAILED DESCRIPTION OF THE DISCLOSURE

Figure 1:
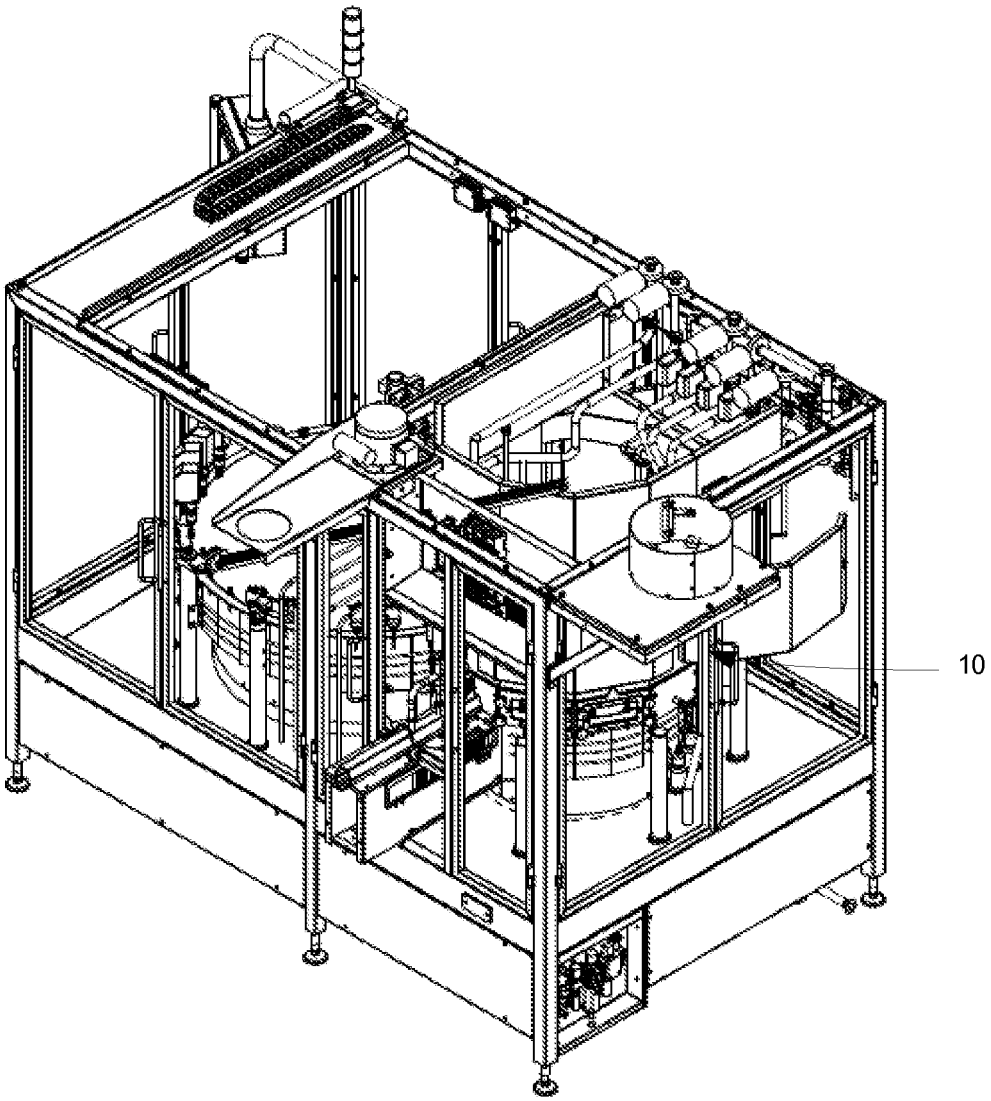
FIG. 1 of the drawings is a perspective view of the pouch fill assembly of the present disclosure, showing the pouch fill assembly, and the rotatable pouch cap assembly extending from the outlet of the pouch fill assembly, and a pouch cleaning assembly positioned proximate the inlet thereof.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the aseptic pouch filling assembly is shown generally at 10. It will be understood that the aseptic pouch filling assembly is configured for the filling of pouches in an aseptic environment and within an aseptic zone. It will be understood that an aseptic zone comprises a zone that is under a positive flow of sterilized gas (typically sterilized air), and that has been cleaned to aseptic standards such as those disclosed in Title 21 of the Code of Federal Regulations pertaining to thermally processed low acid foods packaged in hermetically sealed containers overseen by the U.S. FDA, as well as 3-A Sanitary Standards, Inc. and European Hygienic Engineering and Design Group (EHEDG) Standards.

Figure 9:
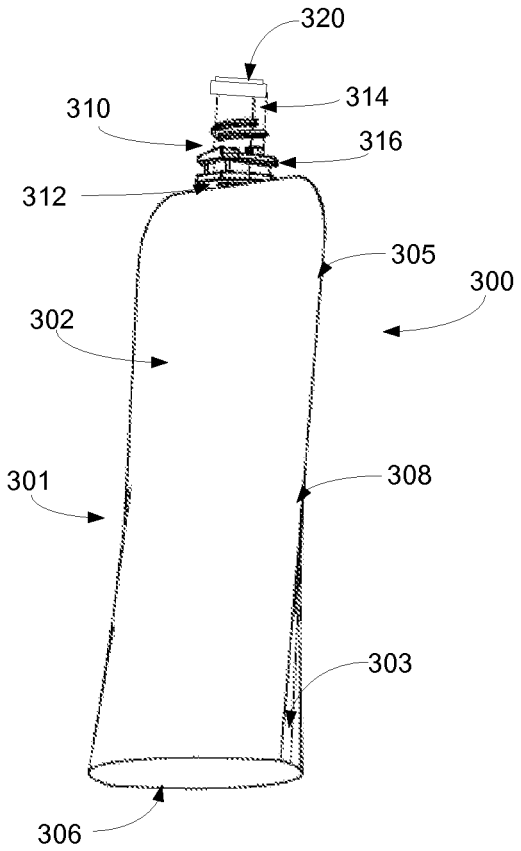
FIG. 9 of the drawings is a perspective view of the pouch that is configured for filling in the pouch fill assembly of the present disclosure.

A typical pouch with which the system is associated is shown in FIG. 9 generally at 300. As will be understood, the pouch (in a capped configuration) is pre-sterilized prior to introduction into the filler equipment 10 through, for example, gamma, x-ray, e-beam or other sterilization process, such that the internal cavity of the pouch is free of pathogens and a sterile environment. The pouch 300 includes body 301 and spout 310. The body 301 includes first side panel 302, second side panel 303, lower gusset structure 306. The first side panel, the second side panel and the lower gusset structure are coupled together through seals 308 to form cavity 305 configured to retain a flowable material, such as a foodstuff or the like. In many configurations, the gusset structure 306 provides a base surface from which the pouch can be in a standup configuration. Of course, in other configurations, the pouch can be formed from a plurality of panels greater than two panels or from a single panel along with a plurality of folds, wherein the panels cooperate to form the gusset at the lower end thereof. Furthermore, additional structures or gussets (such as side gussets) or gussetless constructions are likewise contemplated. Typically, the cavity is on the order of 60 ml to 500 ml in size. More preferably, the cavity is on the order of 60 ml and 180 ml in size, and more preferably, the cavity is on the order of 90 ml to 120 ml. Of course, variations are contemplated, and the foregoing cavity volumes are exemplary only, and not considered to be limiting. Prior to introduction into the cartridge filling assembly, the pouches have been sterilized through gamma sterilization or the like. As such, the cavities are free of pathogens, and are a sterile environment. The plug has a hermetic seal thereby precluding the passage of material into (or out of) the spout. Generally, such pouches are formed from a multi-layer polymer structure that may include metal or metallized layers, and which may be co-extruded and/or laminated.

Spout 310 is shown as comprising attachment flange 312, outlet tube 314 and grasping flanges 316. The attachment flange (often referred to as a sealboat) is typically sandwiched between the first and second side panels and sealed thereto. The outlet tube 314 provides communication with the cavity 305 and provides the means by which to insert or remove flowable material to and from the cavity. In the configuration shown, the outlet tube 314 is capped with a plug 320 which may extend over the outer surface of the outlet tube 314 or within the confines of the outlet tube to preclude access to the cavity 305. It will be understood that a hermetic seal is formed between the plug and the outlet tube through an interference fit. The grasping flanges 316 extend about the outside of the outlet tube. The grasping flanges provide slots and channels by which the pouch can be grasped, retained, handled, and/or captured by different components of the filling equipment.

Figure 10:
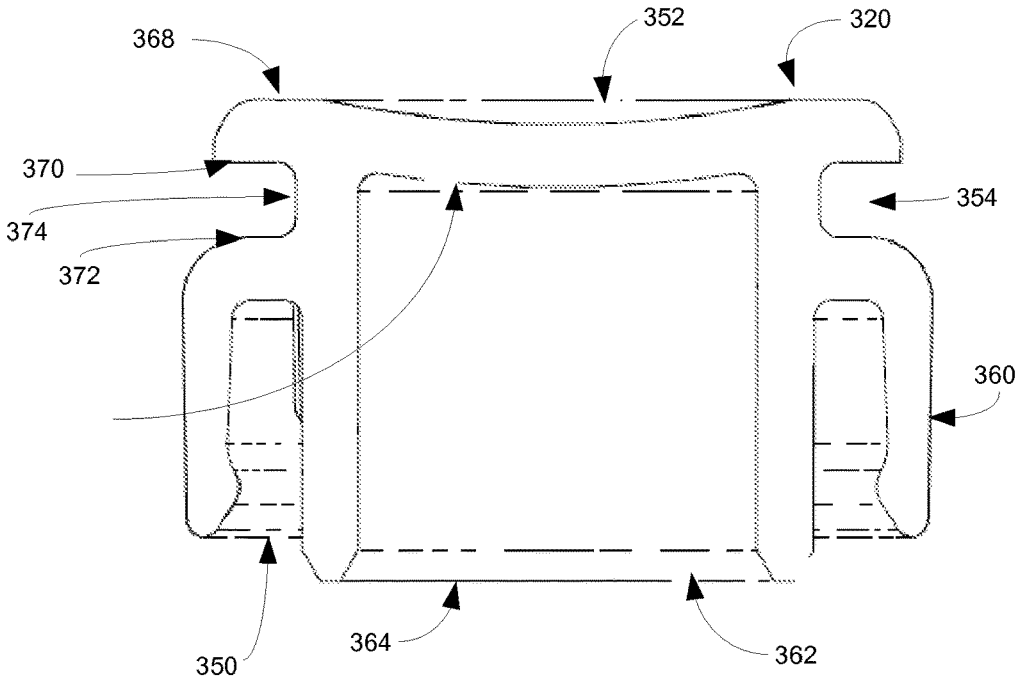
FIG. 10 of the drawings is a cross-sectional view of the plug that is positionable on the spout to seal the cavity of the same.
Figure 11:
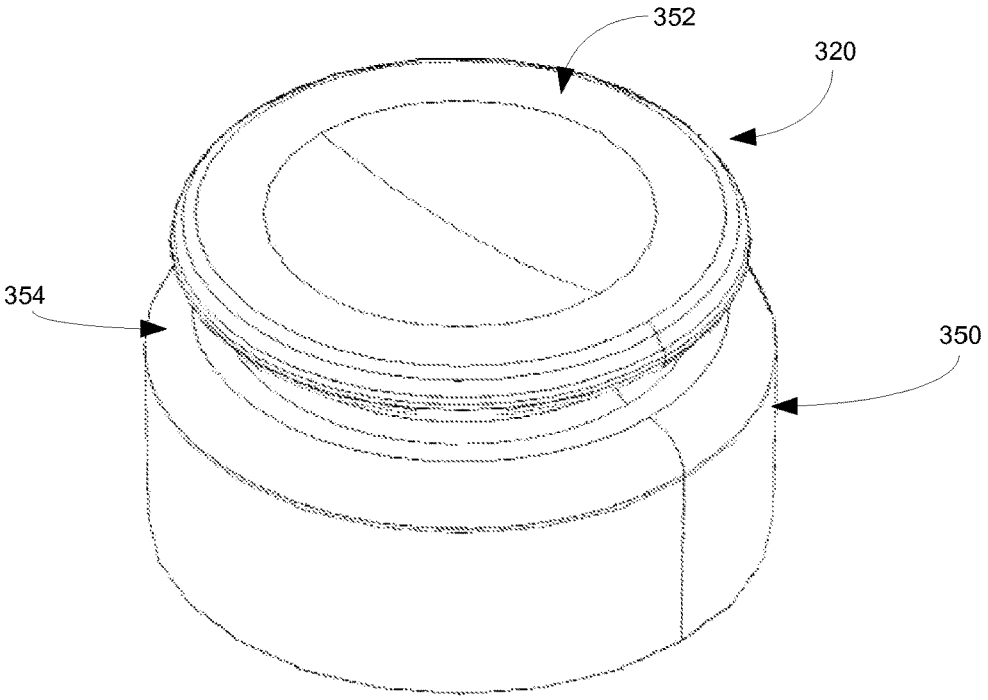
FIG. 11 of the drawings is a perspective view of the plug that is positionable on the spout to seal the cavity of the same.

The plug 320 is shown in FIGS. 10 and 11 as comprising body 350, top wall 352 and annular channel 354. The body includes outer surface 360, lower end 364 and upper end 366. The body is generally an elongated cylindrical member which defines inner cavity 362 which is likewise generally cylindrical. The top wall includes outer surface 368 and generally defines the upper end of the body. The annular channel includes upper wall 370, lower wall 372 and inner wall 374. The annular channel is configured, as will be explained for the grasping of and the retaining of the plug by the filling equipment. The upper and lower walls, in the configuration shown, are generally parallel to each other and spaced apart from each other. The upper wall is formed by an extension of the top wall, although other configurations are contemplated. In addition, it will be understood that other configurations which allow for the grasping by outside grippers or other equipment is likewise contemplated.

Referring again to FIGS. 1 and 2, collectively, the pouch fill assembly 10 is configured to receive pouches, remove the plug, fill the pouch, reposition or reattach the plug and to direct the pouch out of the aseptic zone of the filler to a capper or the like. The pouch fill assembly 10 includes inlet 12, outlet 13, movement assembly 14, plug removing station 15, filling station 16, and recapping station 17. In the configuration shown, the filler is a rotary type filler that rotates about an axis 19 that processes four pouches simultaneously at each station. In other configurations, a greater or fewer amount of pouches can be handled simultaneously in each station. In still other configurations, a linear system, as opposed to a rotary system may be utilized.

Figure 2:
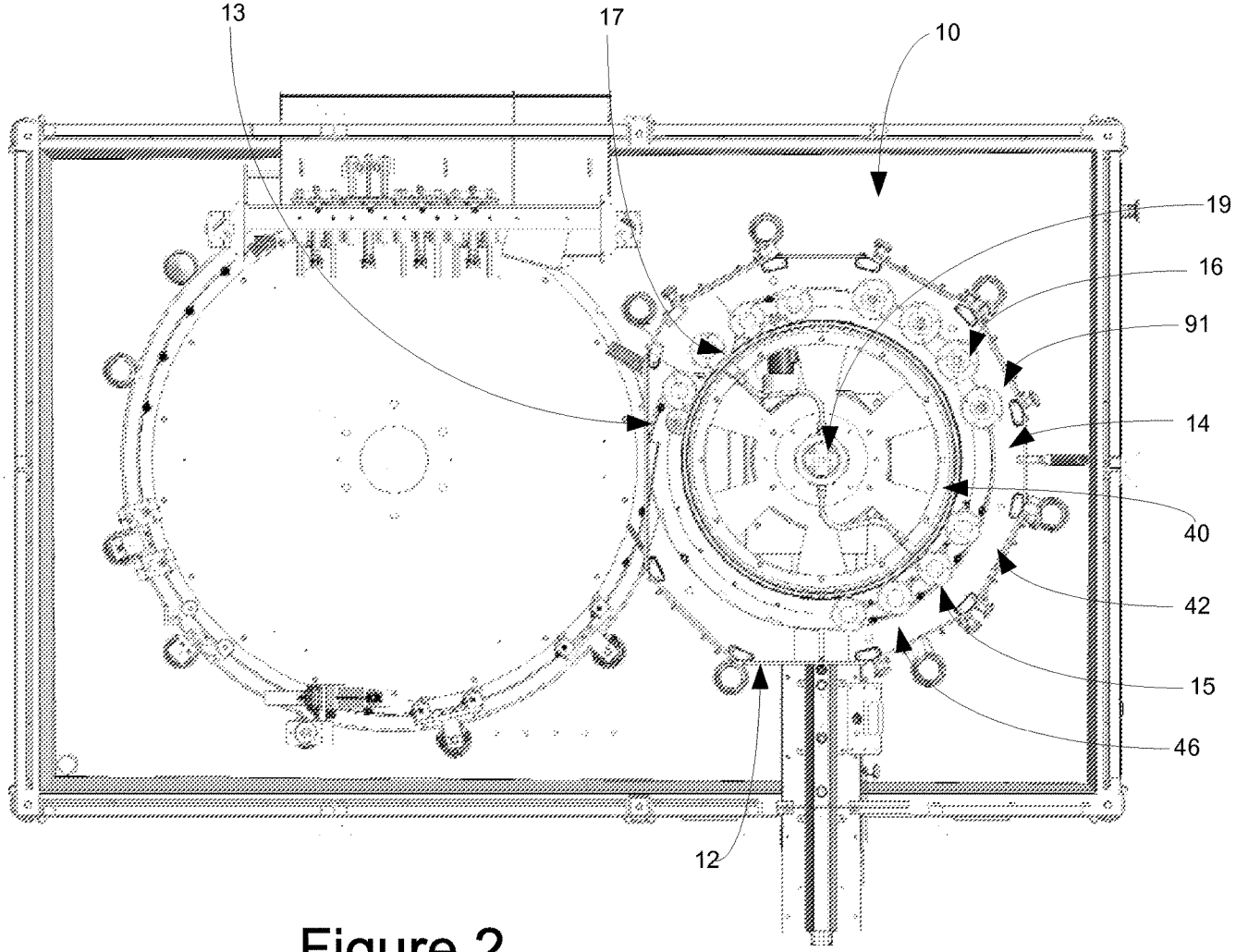
FIG. 2 of the drawings is a top plan view of the pouch fill assembly, the rotatable pouch cap assembly and the pouch cleaning assembly of the present disclosure.
Figure 3:
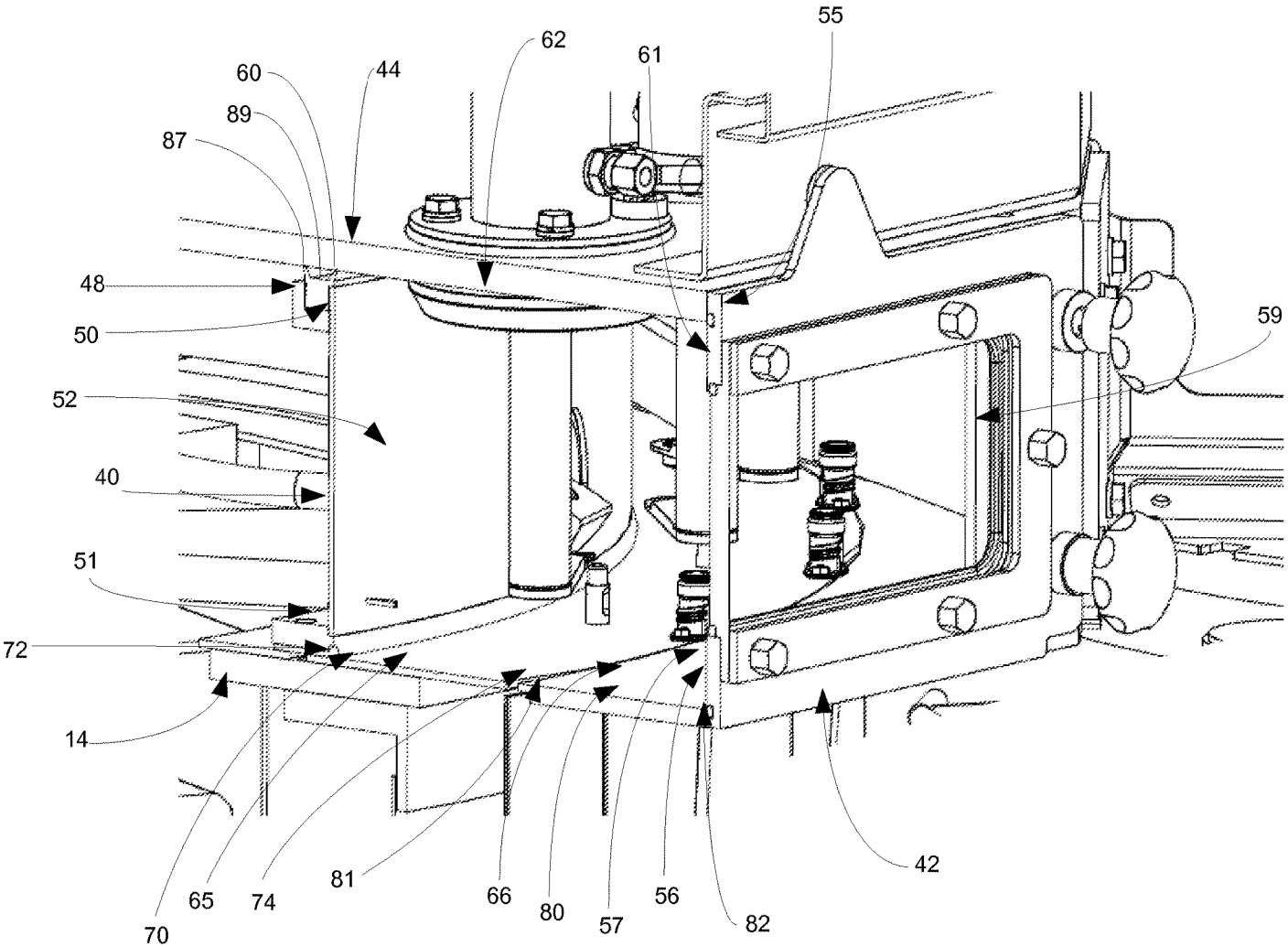
FIG. 3 of the drawings is partial cross-sectional perspective view of the pouch fill assembly of the present disclosure, showing in particular the movement assembly of the pouch fill assembly, and the configuration thereof, both in cross-sectional rectangular configuration, as well as hoop like configuration.
Figure 4:
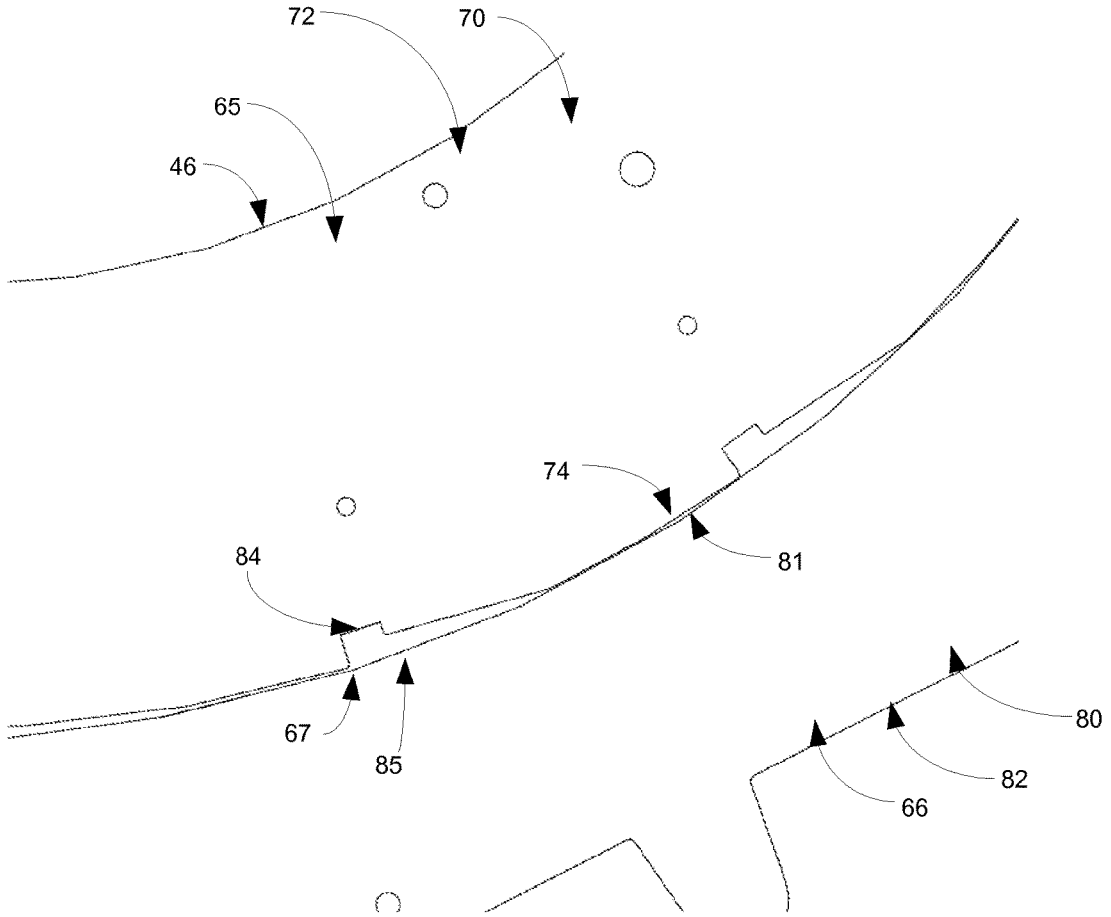
FIG. 4 of the drawings is partial top plan view of the inner and outer portions of the base wall of the movement assembly of the pouch fill assembly of the present disclosure.

With additional reference to FIGS. 2, 3 and 4, the movement assembly 14 includes inner wall 40, outer wall 42, upper wall 44 and base wall 46. The inner wall 40 includes upper end 50, lower end 51, and inner surface 52. The inner surface 52 is generally curved on an radius that is centered on the axis of rotation. The inner surface is generally planar between the upper and lower ends. It is contemplated that nozzles may extend through the inner wall at openings. Such nozzles may be configured to administer cleaning fluids, sterilized air, or any other fluid as desired. They may be utilized during the filling process, or in a cleaning process or sterilization process. As will be explained some of the movement assembly is rotatably movable about an axis relative to other portions thereof, which are generally fixed to a frame or the like. Thus, a portion of the movement assembly can rotate relative to other portions of the movement assembly.

The outer wall 42 includes upper end 55, lower end 56 and inner surface 57. Generally, the height of the outer wall and the inner wall substantially correspond. In addition, the two are generally spaced apart from each other a predetermined distance that is generally uniform. As such, the outer wall is likewise curved about the same axis of rotation 19. In the configuration shown, the outer wall may have a plurality of access openings which may comprise cutouts that generally form a substantially planar outer surface. A cover 59, which may be opaque, translucent or transparent may be releasably coupled thereto. Such a cover provides for visual inspection as desired as well as removal as desired. It will be understood that these openings and covers are generally provided with sealing gaskets and the like so as to be in a substantially sealed configuration.

The upper wall 44 includes inward end 60, outward end 61 and inner surface 62. The inward end 60 generally corresponds to the upper end 50 of the inner wall 40. The outward end 61 generally corresponds to the upper end 55 of the outer wall 42. The upper wall 44 is generally substantially planar and generally provides a surface upon which the different component of the plug removing station, the filling station and the plug replacement station can be mounted.

The base wall 46 includes inner portion 65, outer portion 66 and cooperative retaining clot 67. The base wall is generally perpendicular to each of the inner wall and the outer wall. The inner portion 65 includes upper surface 70, inner chamber end 72 and outer chamber end 82. The inner chamber end 72 generally corresponds to the lower end 51 of the inner wall 40. The outer edge 74 is generally spaced apart therefrom and defines a curve with a matching axis of rotation 19.

The outer portion 66 includes upper surface 80, inner edge 81 and outer chamber end 82. The outer portion is generally co-planar with the inner portion so that the upper surface 70 and the upper surface 80 are substantially planar or generally parallel to each other if offset. The inner edge 81 of the outer portion generally corresponds to the outer edge 74 of the inner portion so as to be in side to side configuration and generally in a matching configuration. The outer chamber end 82 generally corresponds to the lower end 56 of the outer wall 42.

The cooperative retaining slot 67 includes inner profile 84 and outer profile 85. It will be understood that a number of the inner profiles are positioned in a spaced apart configuration along the outer edge 74 of the inner portion. In the configuration shown, the inner profile includes an accepting zone for receiving a pouch, and a retention flange which precludes further relative movement of the pouch and captures the pouch. The inner edge of the outer portion includes the outer profile, which cooperates with the inner profile to generally preclude movement of the spout from within the inner profile while the spout is within the filler. It is the cooperation between the inner and outer profiles that maintains the spout in the necessary configuration within a station, and which directs the spout from station to station. It will be noted that preferably, the spout is captured by the grasping flanges 316 so that the spout outlet tube is within the aseptic zone, while the pouch body 301 remains outside and the aseptic zone below the base wall. In such a configuration, the pouch, which is typically difficult to clean to aseptic standards can remain outside of the aseptic zone, while the pouch is being filled.

In the configuration show, the inner wall 40, the outer wall 42, the upper wall 44 and the base wall 46 together form a hoop-like chamber which comprises the aseptic zone. The configuration has a generally rectangular cross-sectional configuration, at any given point, and is substantially uniform therearound. It will be understood that within the aseptic zone, aseptic conditions are maintained, as is positive flow of sterilant. The inner wall 40 and the inner portion 65 of the base wall 46 are coupled to each other so as to be joined together. These two components move in unison. Similarly, the outer portion 66 of the base wall 46 along with the upper wall 44 and the outer wall 42 are coupled together. In the configuration shown, the inner portion of the base wall is configured to rotate while the outer portion of the base wall is configured to be substantially fixed.

In such a configuration, the outer profile of the cooperative retaining slot 67 is substantially uniformly circular, with the inner profile comprising slots and channels that are directed into the inner profile 84. In such a manner, the rotation of the inner edge and the outer edge is configured to be in very close abutment, to minimize the sterilant directed therethrough. It will be understood that in certain configurations, a seal may be provided, however it has been found that the variations caused by the inner profile provide small openings which allow for the passage of relatively insignificant quantities of steriliant (i.e., sterilized air or other gas).

To further minimize the passage of sterilant (i.e., sterilized air or other gas), chamber seal is provided proximate the surfaces of the movement assembly that have relative movement. For example, upper inner wall seal 48 is provided at the upper end 50 of the inner wall 40, so as to seal the same relative to the upper all 44. In the configuration shown, the seal comprises a pair of opposing ridges 87 and a central valley 89 therebetween. The ridges extend upwardly from the inner wall and sealingly engage the inner surface 62 of the upper wall. A sterilant, cleaning fluid or the like may be injected therebetween so as to reside within the valley 89 therebetween to provide additional protection against the introduction of microbes or the passage of microbes therebeyond. It will be understood that over time, such a seal may wear due to the constant movement of the inner wall relative to the upper wall.

It will be understood that the disclosure is not limited to the relative wall movements disclosed. That is, it is contemplated that the base wall may move relative to each of the other walls, that multiple walls may move in opposing directions, among other solutions. It is further contemplated that the base wall may remain stationary with other walls, such as the upper wall being movable relative thereto.

Figure 5:
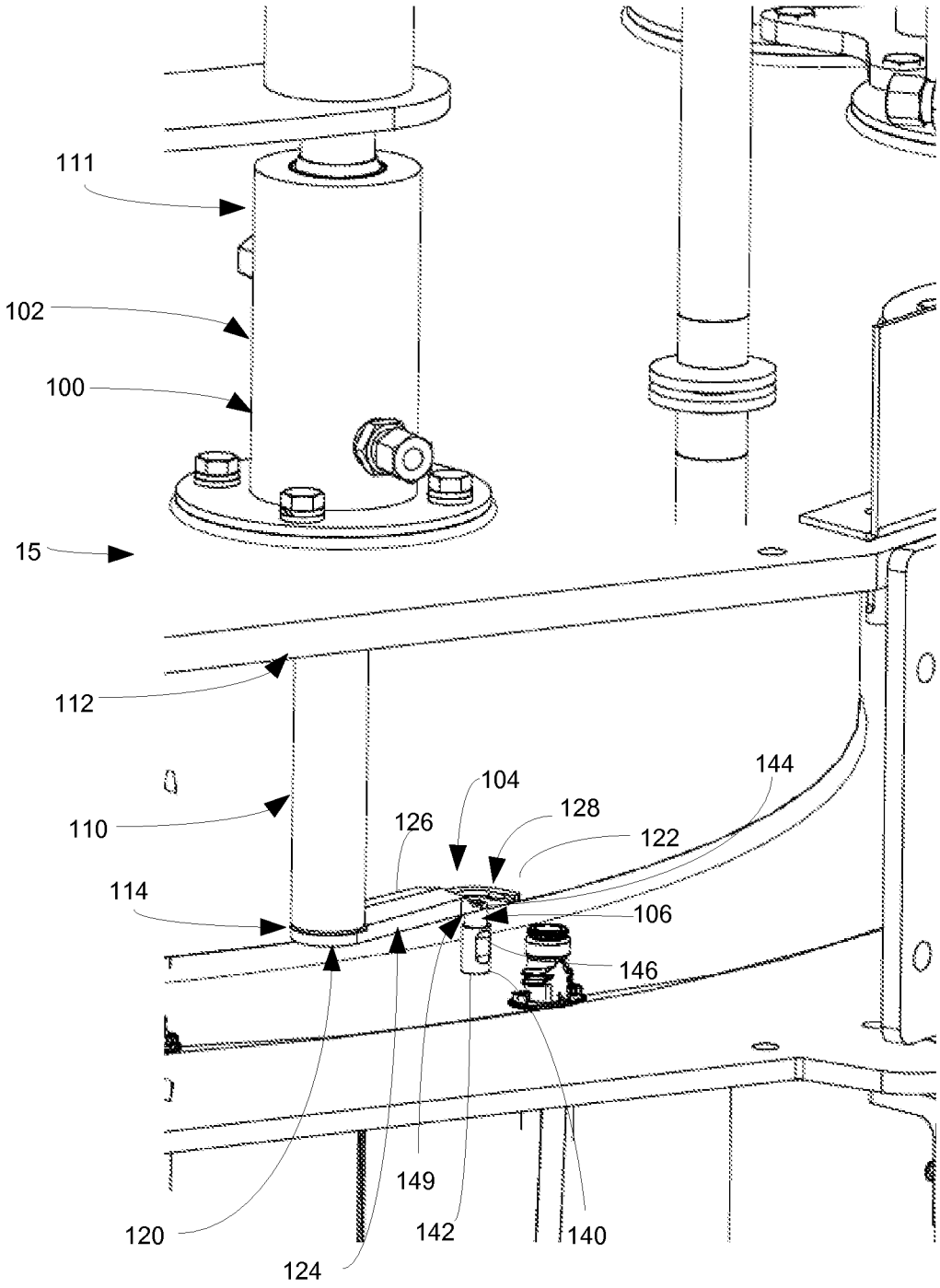
FIG. 5 of the drawings is a partial cross-sectional perspective view of the pouch fill assembly of the present disclosure, showing in particular one of the plug removing stations of the plug removing stations, with the plugs maintained on the respective spout prior to removal therein.
Figure 6:
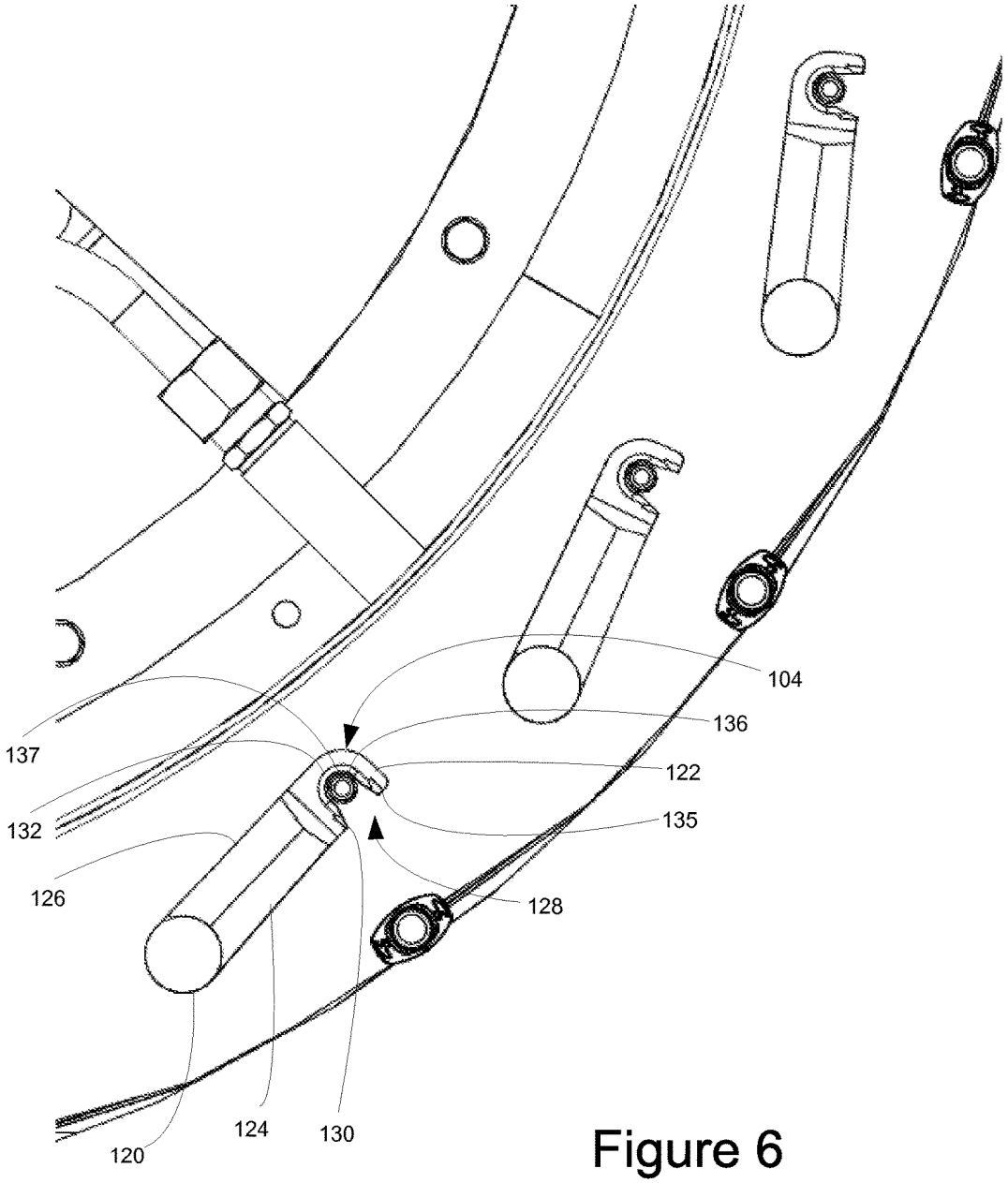
FIG. 6 of the drawings is a partial top plan view showing, in particular, the grasping assembly of the plug removing stations of the plug removing assembly of the present disclosure.

The plug removing assembly 15 is shown in FIGS. 5 and 6 as comprising a plurality of separate stations (in this case four stations). The plurality of separate stations are positioned angularly relative to each other in a spaced apart configuration. A single plug removing station 100 will be described with the understanding that the other plug removing stations are substantially identical thereto. The plug removing station 100 includes actuator assembly 102, grasping assembly 104 and plug retaining structure 106. The plug removing station is tasked with the capturing of the plug, the removal of the same and the placement of the same on the plug retaining structure.

The actuator assembly includes arm 110 and movement mechanism 111. The movement mechanism may comprise a pneumatic, electric, or cam driven component which can direct the arm through rotation and translation. The movement mechanism is mounted to the upper wall so that the arm extends through the upper wall toward the base wall so as to overlie the inner portion thereof. As gasket or the like provides sealed engagement between the component and the aseptic chamber so as to preclude the passage of material therebetween (i.e., sterilant or other material out, and non-sterile items in). The arm 110 includes upper end 112 and lower end 114. The arm is configured to extend into and out of the movement mechanism. The arm is offset from a cooperative retaining slot, such as slot 67 of the base wall 46.

The grasping assembly 104 is shown in FIGS. 5 and 6 as comprising inner end 120, outer end 122, first side 124, second side 126 and capturing slot 128. The grasping assembly is mounted proximate the inner end 120 to the lower end 112 of the arm 110. The grasping assembly is generally configured to extend substantially perpendicularly to the arm 110 of the actuator assembly. In the configuration shown, the relationship is perpendicular, and the grasping assembly is substantially planar. It is of course, merely exemplary, and other relationships are likewise contemplated. As the outer end is configured to both rotate and translate, the outer end is spaced apart from the arm and the axis of rotation thereof. It is contemplated that more complex multi link configurations are likewise contemplated.

The capturing slot 128 is positioned proximate the outer end 122 with an opening toward the first side 124. The capturing slot 128 includes entry region 130, and retaining portion 132. The entry region includes an opening having an inclined edge. The retaining portion is substantially semicircular and includes seating edge 136 and inclined rim 137. It will be understood that the retaining portion is configured to enter into the annular channel 354 of the plug 320 and to releasably retain the plug thereby. The transition from the entry region to the retaining portion elastically deforms the plug so as to provide some resistance to removal of the plug from within the capturing slot.

Figure 12:
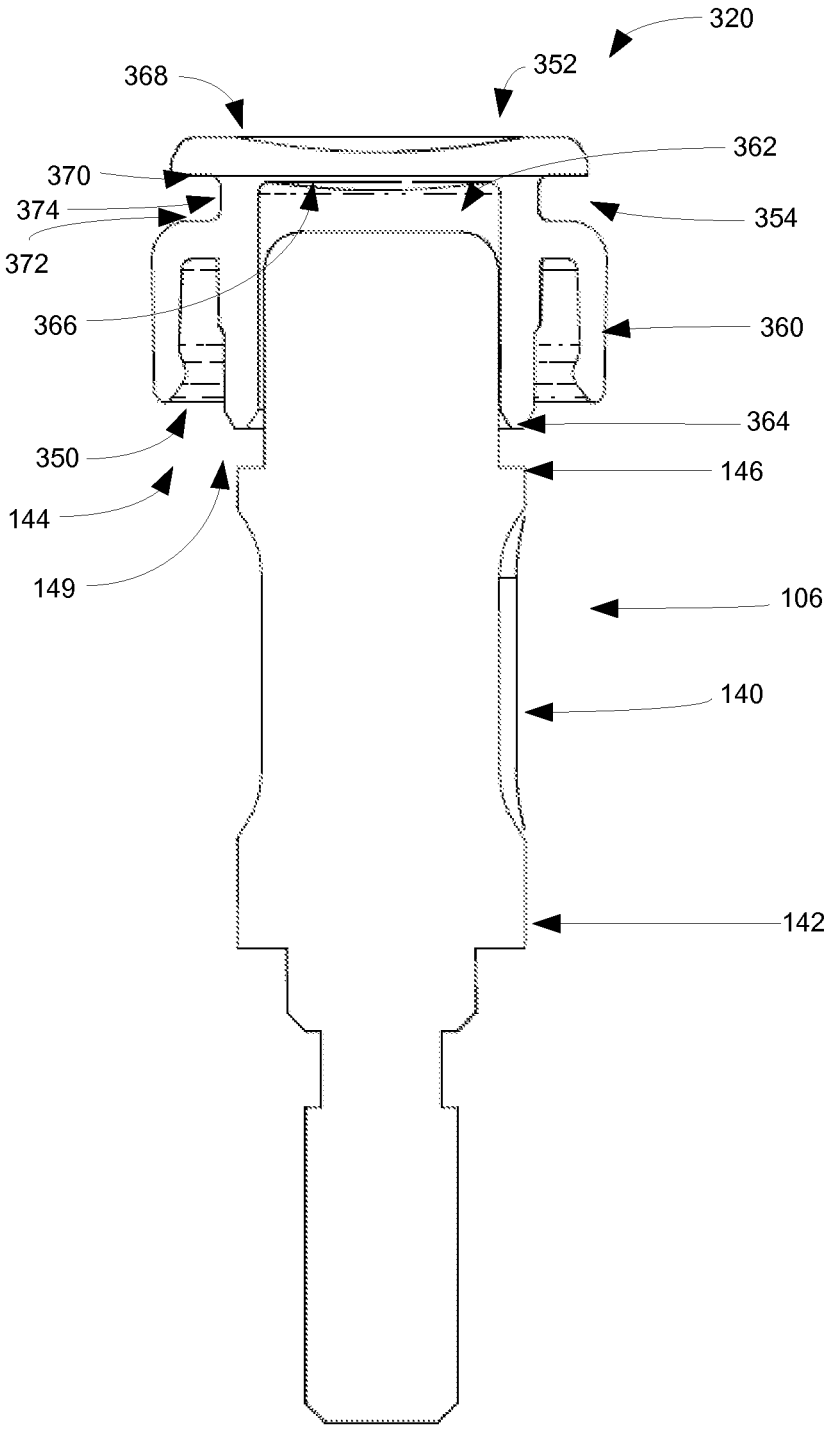
FIG. 12 of the drawings is a cross-sectional view of the plug retaining structure having a plug positioned thereon, showing, in particular, the maintenance of the seal beads and the spout engaging and sealing structures spaced apart from the plug retaining structure.

The plug retaining structure 106 includes elongated post member 140 which is positioned in a spaced apart orientation form the respective cooperative retaining slot 67 of the base wall 46. The elongated post member 140 includes lower end 142, upper end 144 and seat flange 146. The lower end 142 extends from the upper surface of the inner portion of base wall 46 with the elongated post member extending substantially perpendicularly upward to the upper end 144. Between the upper and lower end, a seat flange 146 is disposed to define the plug portion 149 thereabove. The plug portion is configured to receive the plug thereon, with the seat flange defining the distance of travel of the plug along the elongated post member. A cross-sectional configuration of the plug retaining structure having the plug portion positioned thereon is disclosed in FIG. 12.

The operation of the plug removing station 100 will be described briefly herein, and in greater detail below. More particularly, the operation begins with the positioning of a pouch within the cooperative retaining slot associated with the plug removing station. Next, the actuator assembly directs the arm 110 so that the grasping assembly 104, and in particular, the capturing slot is directed into the annular channel 354 of the plug of the pouch in the cooperative retaining slot of the base wall.

Once the plug is engaged by the grasping assembly 104, the actuator assembly 102 is directed upwardly to remove the plug from the spout. Once removed, the grasping assembly 104 is rotated by the actuator assembly away from the spout and in a position where the plug overlies the plug retaining structure 106. Once in the proper position, and with reference to FIG. 12, the plug is directed downward by the actuator assembly so that the plug portion 149 extends into the inner cavity 362 of the body 350 of the plug. Once the plug either bottoms out, or reaches the seat flange 146, or otherwise is positioned on the plug retaining structure sufficient to insure that it will not inadvertently be disconnected or dislodged therefrom, the actuator assembly again rotates, this time away from the plug retaining structure. Such a movement decouples the plug from the grasping assembly. The grasping assembly is moved away, leaving the removed plug on the elongated post member, and the spout in an open configuration. Advantageously, the structures of the plug that are configured to seal against and to capture the outlet tube of the spout are spaced apart from the plug retaining structure that remains within the bounds of the inner cavity of the body of the plug. As a result, inadvertent damage to these structures of the plug can be avoided.

The filling assembly 91 is shown in FIG. 2 and is positioned in a angularly spaced apart orientation from the plug removing assembly. The filling assembly 91 comprises a plurality of filling heads, in the configuration shown, four spaced apart filling heads that have the same spacing as the spacing between plug removing stations. The filling heads are configured to engage and fill the pouches with a flowable material which is supplied to the filling heads. The filling heads can be selectively directed to, engaged and disengaged with the filling heads as prescribed to fill the pouches and to prepare the pouches for repositioning the plug on the spout, thereby sealing the cavity of the pouch. It will be understood that any number of different filler valves may be utilized for the filling heads.

Figure 7:
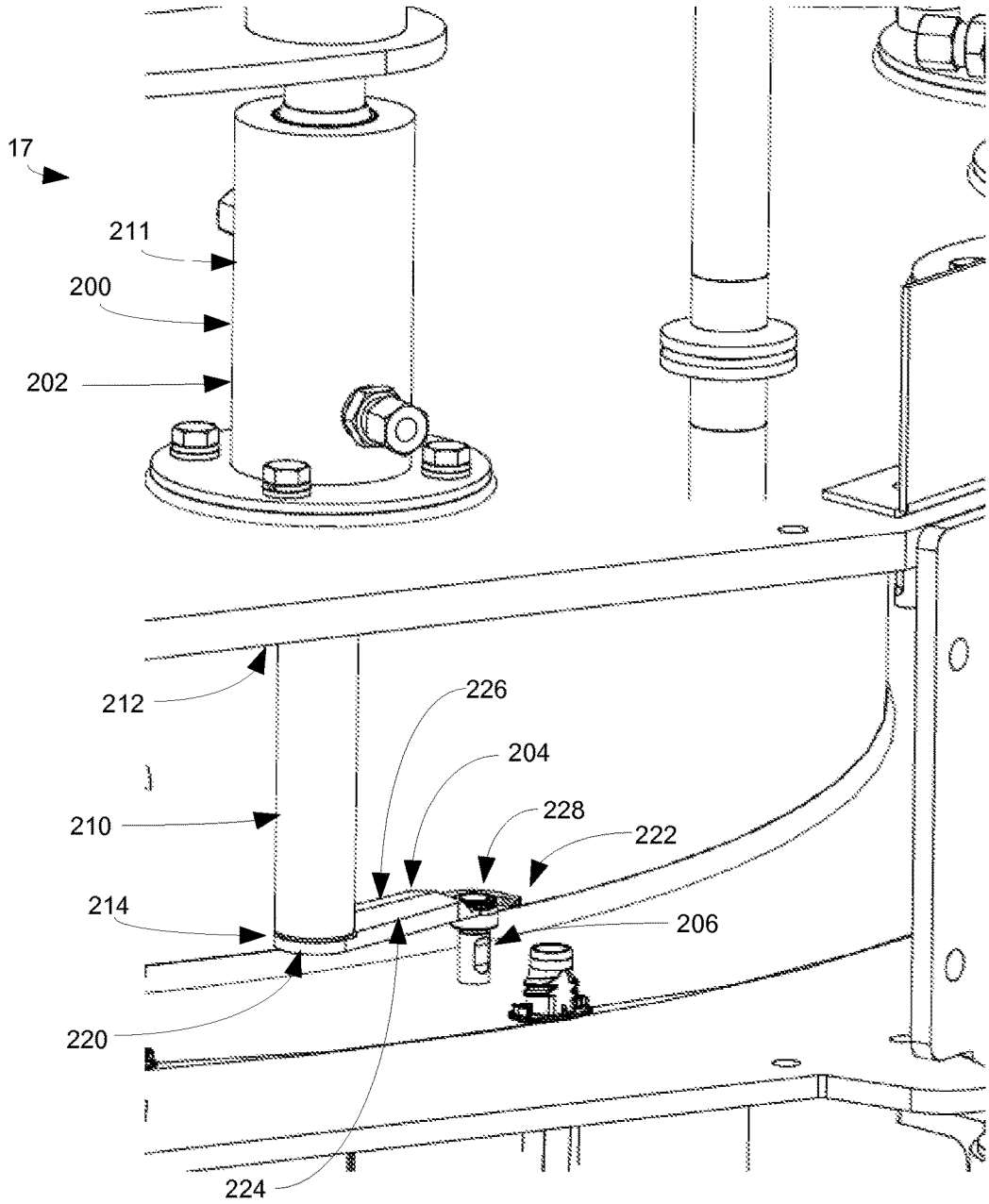
FIG. 7 of the drawings a partial cross-sectional perspective view of the pouch fill assembly of the present disclosure, showing in particular one of the plug replacement stations, the plug being grasped at the plug retaining structure for movement therefrom to the spout.
Figure 8:
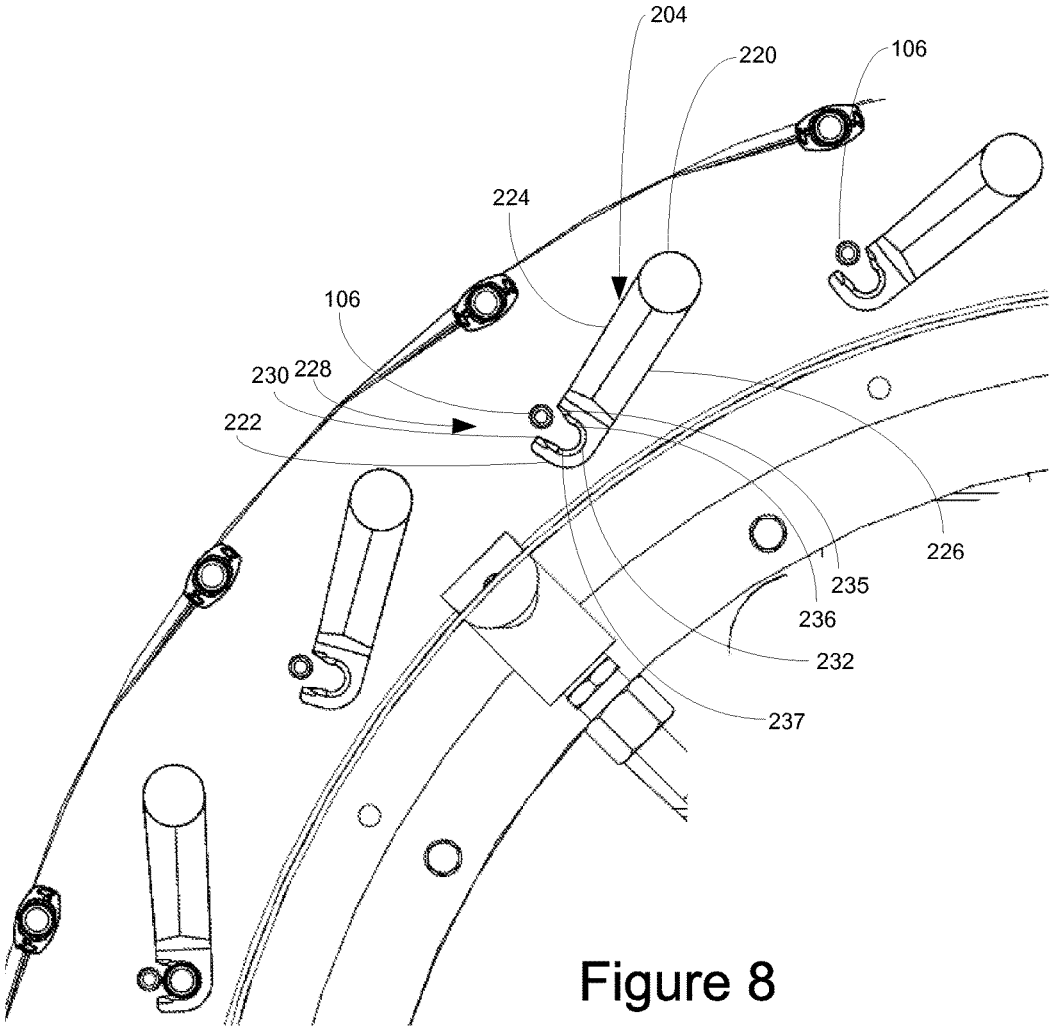
FIG. 8 of the drawings is a partial top plan view showing, in particular, the grasping assembly of the plug replacement stations of the plug replacement assembly of the present disclosure.

The plug replacement assembly 17 is shown in FIGS. 7 and 8 as comprising a plurality of plug replacement stations. In the configuration shown, a total of four recapping stations are shown. It will be understood that they are angularly spaced apart from each other so as to be positioned in substantially the same spacing as the plug removing stations and the filling stations. It is contemplated that in some embodiments, the plug removal assembly and the plug replacement assembly may comprise the same actuator and grasping assembly, with the pouch configured to move between the plug removing station to a fill station and back for replacement of the plug.

The plug replacement station 200 is substantially the same in configuration as the plug removing station 100 in structural configuration. Thus, similar components have the same reference number augmented by 100. The plug replacement station 200 includes actuator assembly 202, grasping assembly 204 which cooperate with a plug retaining structure 106. The plug replacement station is tasked with the capturing of the plug from the plug retaining structure, the removal of the same therefrom and the placement of the plug on the spout of the respective pouch from where removed.

The actuator assembly includes arm 210 and movement mechanism 211. The movement mechanism may comprise a pneumatic, electric, or cam driven component which can direct the arm through rotation and translation. The movement mechanism is mounted to the upper wall so that the arm extends through the upper wall toward the base wall so as to overlie the inner portion thereof. As gasket or the like provides sealed engagement between the component and the aseptic chamber so as to preclude the passage of material therebetween (i.e., sterilant or other material out, and non-sterile items in). The arm 210 includes upper end 212 and lower end 214. The arm is configured to extend into and out of the movement mechanism. The arm is offset from a cooperative retaining slot, such as slot 67 of the base wall 46.

The grasping assembly 204 is shown in FIGS. 7 and 8 as comprising inner end 220, outer end 222, first side 224, second side 226 and capturing slot 228. The grasping assembly is mounted proximate the inner end 220 to the lower end 212 of the arm 210. The grasping assembly is generally configured to extend substantially perpendicularly to the arm 210 of the actuator assembly. In the configuration shown, the relationship is perpendicular, and the grasping assembly is substantially planar. It is of course, merely exemplary, and other relationships are likewise contemplated. As the outer end is configured to both rotate and translate, the outer end is spaced apart from the arm and the axis of rotation thereof. It is contemplated that more complex multi link configurations are likewise contemplated.

The capturing slot 228 is positioned proximate the outer end 222 with an opening toward the first side 224. The capturing slot 228 includes entry region 230, and retaining portion 232. The entry region includes an opening having an inclined edge. The retaining portion is substantially semi-circular and includes seating edge 236 and inclined rim 237. It will be understood that the retaining portion is configured to enter into the annular channel 354 of the plug 320 and to releasably retain the plug thereby. The transition from the entry region to the retaining portion elastically deforms the plug so as to provide some resistance to removal of the plug from within the capturing slot.

The plug retaining structure 106 (which comprises the identical structure) as the base wall rotates, the plug retaining structures rotate therewith and the same plug retaining structure interfaces with each of the plug removing assembly and the plug replacement assembly. As set forth above, the plug retaining structure includes elongated post member 140 which is positioned in a spaced apart orientation form the respective cooperative retaining slot 67 of the base wall 46. The elongated post member 140 includes lower end 142, upper end 144 and seat flange 146. The lower end 142 extends from the upper surface of the inner portion of base wall 46 with the elongated post member extending substantially perpendicularly upward to the upper end 144. Between the upper and lower end, a seat flange 146 is disposed to define the plug portion 149 thereabove. The plug portion is configured to receive the plug thereon, with the seat flange defining the distance of travel of the plug along the elongated post member.

Briefly, the operation of the plug replacement station 200 is generally the inverse of the plug removing station. In particular, the plug initially is positioned on the plug retaining structure 106 which is associated with the pouch within the cooperative retaining slot 67. The grasping assembly 204 is both rotated and/or translated so that the capturing slot 228 of the grasping assembly engages the plug, directing the plug to the entry region 230 and into the retaining portion 232. Once in the retaining portion of the grasping assembly 204, the plug can be translated upward to decouple the plug from the elongated post member 140.

Next, the plug can be rotated and translated so as to be positioned over the spout of the corresponding pouch. Once in the proper position, the plug can be directed to engage the spout and to seal the opening of the spout. Once the engagement has been made, the grasping assembly can be rotated away from the plug to release the retaining portion 232 of the grasping assembly 204 from within the annular channel 354. At such time, the plug has been repositioned, and the plug replacement station components have been separated therefrom.

The outlet 13 is shown as comprising a handoff zone wherein the pouches are transferred from the cooperative retaining slot 67, out of the aseptic zone and into a capping assembly, and in the embodiment shown, a rotary capping assembly. The capping assembly couples a cap to the spout (preferably rotatably), while coupling the cap to the plug so that the two move in unison.

The method of filling the pouch through the pouch fill assembly will be described with respect to four different sets of pouches. The first set of pouches will be tracked from the inlet to the outlet, with the second through fourth pouches being tracked form the inlet to a station that corresponds to the station wherein such a pouch is situated when the first set of pouches exit from the aseptic zone at the outlet.

In particular, the first set of pouches are first provided and directed sequentially into a cooperative retaining slot of the base wall through capturing of the spout within the cooperative retaining slot, and rotation of the inner portion of the base wall relative to the upper wall (and outer wall). As four plug removing stations, filling stations and plug replacement stations are disclosed, it will be understood that four pouches are provided. It will further be understood that it is contemplated that a greater or lesser amount of stations can be provided with corresponding pouches. It will also be understood that not every station may be active for each of the cycles. For example, one of the stations may be inactive, wherein three pouches will be simultaneously processed.

As the first set of pouches are sequentially directed into cooperative retaining slots, they are directed, substantially simultaneously into position as being associated with a plug removing station 100. When at the respective plug removing station, a corresponding actuator assembly 102, grasping assembly 104 and plug retaining structure 106 is provided. The actuator assembly 102 directs the arm so that the grasping assembly 104 is in position to grasp a respective plug from a respective pouch. The grasping assembly is then directed into contact with the plug so that the plug is directed into the retaining portion 132 of the capturing slot of the grasping assembly. This preferably occurs at each station simultaneously.

Once engaged, the actuator assembly translates the grasping assembly upwardly to remove the plug from the spout. Once removed, the actuator assembly rotates the grasping assembly with the plug to a position wherein the plug overlies the plug retaining structure. Once in the overlying position, the actuator assembly is translated to direct the plug into contact with the plug retaining structure 106 and to direct the plug portion 149 into the inner cavity 362. Again, this process preferably occurs at each station simultaneously.

As the steps are complete at the plug removing stations, the inner portion of the base wall is rotated to direct the first set of pouches (now uncapped) from the plug removing stations to the filling stations. It will be understood that as the first set of pouches are directed to the filling station, a second set of pouches is sequentially introduced into cooperative retaining slots and rotated to the plug removing stations. The above process is repeated with the second set of pouches.

The first set of pouches, are coupled to the filling stations 91, and filled with the flowable material provided to the filling stations. Due to the coordinated movement and timing, as these pouches are filled, the plugs have been removed from the second set of pouches. At such time, the inner portion of the base wall is rotated and the first set of pouches are positioned in the plug replacement assembly, at respective stations. The second set of pouches are rotated from the plug removing assembly to the filling assembly, and in particular, situated at a respective filling station. A third set of pouches have been introduced into respective cooperative retaining slots and are directed to the plug removing assembly.

As the plugs are removed from the third set of pouches, and the second set of pouches are filled, the first set of pouches have the plug recapped. It will be noted that the plug retaining structure 106 is coupled to the inner portion 65 of the base wall, and, as such, as the inner portion of base wall is rotated, the pouch rotates with the plug that was removed from the pouch. Thus, when recapped, the pouch is recapped with the same plug that was removed therefrom.

More particularly, at each plug replacement station, the grasping assembly 204 is rotated and/or translated so as to direct the retaining portion 232 of the capturing slot 228 into the annular channel 354 of the plug. Once the plug has been releasably coupled to the grasping assembly, the actuator assembly is directed to translate upwardly to separate the plug from the plug portion 149 of the elongated post member 140. Once cleared, the plug is rotated and/or translated so that the plug overlies the spout of the respective pouch. Once positioned, the plug can be translated so as to engage the spout and seal the cavity of the spout. Once positioned in sealing engagement with the spout, the actuator assembly can rotate the grasping assembly so that the annular channel releases from the capturing slot separating the plug from the grasping assembly. The grasping assembly can then be rotated and/or translated out of the path of the successive pouches.

As the plug replacement is completed with respect to the first set of pouches, the second set of pouches have completed filling at respective filling stations. Additionally, the plugs have been removed from the first set of pouches and positioned on respective plug retaining structures.

As the inner portion of the base wall is again rotated, the first set of pouches approaches the outlet, wherein the pouches are directed out of the aseptic zone and sequentially transferred to the rotary capper. At the same time, the second set of pouches are directed from the filler stations to the plug replacement stations; the third set of pouches are directed from the plug removing stations to the filler stations; and a fourth set of pouches are introduced sequentially into cooperative retaining slots and to respective stations of the plug removing station. This cycle can continue with successive ones of the sets of pouches exiting through the outlet in a filled condition, and new sets of pouches entering through the inlet. It will be understood that the pouches at the inlet to the filler are internally sterilized, and the spouts of the pouches have been sterilized prior to entry into the filler. It will be understood that as the spouts are sterilized prior to entry, and as the aseptic zone maintains positive flow throughout the aseptic zone, pathogens are precluded from entry into the aseptic zone through openings, such as the openings that are present due to the nature of the fit between the inner portion of the base wall and the outer portion of the base wall and the cooperative retaining slot.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A filling device for aseptic filling of pouches comprising:

a pouch fill assembly comprising:

a movement assembly defining an aseptic zone, the movement assembly configured to direct a pouch having a spout and a plug sealing the spout through the pouch fill assembly from an inlet to an outlet;

a plug removing assembly having at least one plug removing station, the plug removing station further including:

a grasping assembly positioned within the aseptic zone structurally configured to releasably capture a portion of the plug;

a plug retaining structure positioned within the aseptic zone structurally configured to releasably maintain the plug upon removal from the spout; and an actuator assembly structurally configured to direct the plug between the spout and the plug retaining structure; and a filling assembly having at least one filling station structurally configured to dispense a flowable material into the pouch through the spout;

wherein the movement assembly further includes a base wall, a portion of which is rotatably positionable relative to the plug removing assembly and the pouch filling assembly, with a cooperative retaining slot defined therein structurally configured to retain a pouch by way of the spout, the base wall including an upper surface, with the plug retaining structure positioned in a spaced apart orientation from the cooperative retaining slot and extending from the upper surface, wherein the grasping assembly is structurally configured to extend between the cooperative retaining slot and the plug retaining structure.

2. The filling device of claim 1 wherein the actuator comprises an arm that is translatable and rotatable relative to the base wall, and having the grasping assembly positioned proximate the lower end thereof, the grasping assembly having a first side and a second side with a capture slot defined in the first side, the capture slot having a retention portion configured to releasably engage the spout.

3. The filling device of claim 2 wherein the retaining structure comprises an elongated post member extending outwardly from the upper surface of the base wall.

4. The filling device of claim 1 further comprising a plug replacement assembly having at least one plug replacement station, the plug replacement station further comprising:

a grasping assembly positioned within the aseptic zone structurally configured to releasably capture a portion of the plug;

a plug retaining structure positioned within the aseptic zone structurally configured to releasably maintain the plug upon removal from the spout; and an actuator assembly structurally configured to direct the plug between the spout and the plug retaining structure.

5. The filling device of claim 4 wherein the movement assembly further comprises a rotary configuration having an axis of rotation, with the spout being rotatably movable along the rotary configuration, and with the plug removing assembly, the filling assembly and the plug replacement assembly being positioned sequentially in a rotary configuration, whereupon rotation thereof, the spout and the plug progress sequentially from the plug removing assembly to the filling assembly and to the plug replacement assembly.

6. A filling device for aseptic filling of pouches comprising:

a pouch fill assembly comprising:

a movement assembly defining an aseptic zone, the movement assembly configured to direct a pouch having a spout and a plug sealing the spout through the pouch fill assembly from an inlet to an outlet;

a plug removing assembly having at least one plug removing station, the plug removing station further including:

a grasping assembly positioned within the aseptic zone structurally configured to releasably capture a portion of the plug;

a plug retaining structure positioned within the aseptic zone structurally configured to releasably maintain the plug upon removal from the spout; and an actuator assembly structurally configured to direct the plug between the spout and the plug retaining structure; and a filling assembly having at least one filling station structurally configured to dispense a flowable material into the pouch through the spout;

the movement assembly further comprising:

a hoop like member defined by an inner wall, an outer wall, an upper wall and a base wall, the hoop like member having an axis of rotation, the base wall further comprising:

an inner portion and an outer portion, one of the inner portion and the outer portion being fixedly coupled to the upper wall, with the other of the inner portion and the outer porting being rotatably positionable relative to the upper wall.

7. The filling device of claim 6 wherein, the inner portion is rotatably positionable relative to the upper wall:

the cooperative retaining slot portion of the inner portion directs movement of the spout, and in turn, the pouch;

the plug removing station and the filler station are coupled to the upper wall so that the inner portion of the base wall is rotatably movable relative to the plug removing station and the filler station; and the plug retaining structure is positioned proximate the cooperative retaining slot so as to extend from an upper surface of the inner portion of the base wall.

8. The filling device of claim 7 wherein the inner wall is fixedly coupled to the inner portion of the base wall so as to rotate together therewith, with the outer wall being fixedly coupled to the upper wall and to the outer portion of the base wall wherein the inner wall rotates relative to each thereof.

9. The filling device of claim 8 further including a chamber seal between the inner wall and the upper wall, the chamber seal comprising a pair of opposing ridges extending from the inner wall to the upper wall, and sealingly engaging the upper wall, with a valley therebetween, the valley structurally configured to retain either a fluid or a gas therebetween.

10. A filling device for aseptic filling of pouches comprising:

a pouch fill assembly comprising:

a movement assembly defining an aseptic zone, the movement assembly defining a hooplike configuration, a portion of which is rotatable about an axis of rotation, and relative to another portion thereof which is substantially fixed, the rotatable portion including at least one cooperative retaining slot configured to releasably receive a spout of a pouch;

a plug removing assembly having at least one plug removing station coupled to the fixed portion of the movement assembly, with at least one plug retaining structure coupled to the rotatable portion of the movement assembly proximate each cooperative retaining slot and rotatable therewith;

a filler assembly having at least one filler head coupled to the fixed portion of the movement assembly downstream of the plug removing assembly;

a plug replacement assembly having at least one plug replacement station, the plug replacement station being coupled to the fixed portion of the movement assembly downstream of the filler assembly;

wherein the rotatable portion is structurally configured to rotate at least one pouch and at least one plug associated with the pouch sequentially to each of the plug removing assembly, the filler assembly and the plug replacement assembly, a plug coupled to a pouch is removed, with the pouch filled and then the plug is replaced on the same pouch from which the plug was removed, with the plug rotating along with the pouch coupled to the rotatable portion; and wherein the movement assembly further includes an inner wall, an outer wall spaced apart from the inner wall, an upper wall and a base wall spaced apart from the upper wall, the walls cooperate to define a substantially hoop like configuration, the base wall having an inner portion and an outer portion, one of the inner portion and the outer portion being rotatably positionable relative to at least one of the outer wall, the inner wall and the upper wall.

11. The filling device of claim 10 wherein the inner portion of the base wall is rotatable relative to the outer portion of the base wall and the upper wall.

12. The filling device of claim 11 wherein the movement assembly has a substantially rectangular cross-sectional configuration.

13. A filling device for aseptic filling of pouches comprising:

a pouch fill assembly comprising:

a movement assembly defining an aseptic zone, the movement assembly defining a hooplike configuration, a portion of which is rotatable about an axis of rotation, and relative to another portion thereof which is substantially fixed, the rotatable portion including at least one cooperative retaining slot configured to releasably receive a spout of a pouch;

a plug removing assembly having at least one plug removing station coupled to the fixed portion of the movement assembly, with at least one plug retaining structure coupled to the rotatable portion of the movement assembly proximate each cooperative retaining slot and rotatable therewith;

a filler assembly having at least one filler head coupled to the fixed portion of the movement assembly downstream of the plug removing assembly;

a plug replacement assembly having at least one plug replacement station, the plug replacement station being coupled to the fixed portion of the movement assembly downstream of the filler assembly;

wherein the rotatable portion is structurally configured to rotate at least one pouch and at least one plug associated with the pouch sequentially to each of the plug removing assembly, the filler assembly and the plug replacement assembly, a plug coupled to a pouch is removed, with the pouch filled and then the plug is replaced on the same pouch from which the plug was removed, with the plug rotating along with the pouch coupled to the rotatable portion; and wherein the plug removing assembly includes four stations, the plug replacement assembly includes four stations and the filler assembly includes four filler stations, the base wall including sixteen cooperative retaining slots positioned therealong in a spaced apart configuration, and including sixteen plug retaining structures positioned proximate the sixteen cooperative retaining structure.

14. The filling device of claim 13 wherein the plug retaining structure including an elongated post member extending from the base wall and including a lower end and an upper end.

* * * * *